US005771503A

United States Patent [19]

Valimaa et al.

[11] Patent Number: 5,771,503

[45] Date of Patent: Jun. 30, 1998

[54] HUMIDIFIER FOR USE IN A SAUNA STOVE

[76] Inventors: Markku Tapani Valimaa, Hannosentie 5, FIN-41120 Puuppla; Tapani Rautiainen, Pekkalantie 5, FIN-40207 Palokka, both of Finland

[21] Appl. No.: 854,617

[22] Filed: May 12, 1997

[51] Int. Cl.[6] ..... A61H 33/06

[52] U.S. Cl. ..... 4/524; 392/394; 392/403; 239/136

[58] Field of Search ..... 4/524–534; 392/342, 392/394, 402, 403; 126/350 B; 607/81, 83, 84; 239/136

[56] References Cited

U.S. PATENT DOCUMENTS

| | | | |
|---|---|---|---|
| 1,292,759 | 1/1919 | Granger | 392/403 |
| 2,140,516 | 12/1938 | Cowan | 392/402 |
| 2,900,895 | 8/1959 | Schwaneke et al. | 392/403 |
| 3,275,800 | 9/1966 | Kuoppamaki et al. | 4/524 |
| 3,778,593 | 12/1973 | Wikstrom | 4/524 |

FOREIGN PATENT DOCUMENTS

| | | | |
|---|---|---|---|
| 3834755 | 4/1990 | Germany | 4/524 |
| 5-293152 | 11/1993 | Japan | 4/524 |
| 87/05681 | 9/1987 | WIPO | 4/524 |

*Primary Examiner*—Charles R. Eloshway
*Attorney, Agent, or Firm*—Fildes & Outland, P.C.

[57] ABSTRACT

A humidifier for use in a sauna stove includes a high vessel open at the top, forming storage for water to be vaporized. The humidifier is placed in the stone space, or similar heating space, of the sauna stove. When in use, the heat from the heat source vaporizes the water in the vessel, to spread steam to the sauna room. The humidifier includes at least one cup placed on top of the high vessel, in which there is a channel to lead the steam from the lower vessel through the cup to the sauna room.

4 Claims, 2 Drawing Sheets

HUMIDIFIER FOR USE IN A SAUNA STOVE

FIELD OF THE INVENTION

This invention relates to improvements in sauna stoves and more particularly to a humidifier for use in a sauna stove, comprising a high vessel open from above, forming a store of water to be vaporized and intended to be set in the pile of stones in the stove or a similar place close to the heat source, so that in use the heat from the heat source vaporizes the water in the vessel as steam to spread around the sauna.

BACKGROUND OF THE INVENTION

It is known in the art relating to saunas to provide means to vaporize water. Besides throwing water on top of the stones of the stove, various kinds of small vessels are known, which are placed on top of the stones to vaporize water. In addition, various types of humidifiers are known, which are connected to the sauna stove. Scents and aromatic substances can be placed in the water being vaporized by them.

Finnish utility model No. 1965 shows one type of humidifier. A problem with this kind of humidifier is that it is irritatingly noisy in operation. Often, the hot water bubbles from high vessels so violently, that it creates some degree of danger. The present invention provides an improvement over the type of humidifier referred to above.

SUMMARY OF THE INVENTION

An object of the present invention is to provide a humidifier for use in a sauna stove wherein the operation of the humidifier is quiet and absolutely safe.

In carrying out the above object and other objects, the humidifier comprises a high or tall, herein tubular, vessel open at its top end and forming a storage container for water to be vaporized. The vessel is intended to be placed in the stone space of the sauna stove, next to the source of heat, and when in use, the heat from the heat source vaporizes the water in the vessel, to spread steam to the sauna room. The humidifier includes at least one cup, filled with small stones, placed on top of the high vessel. The cup includes a channel in its bottom to lead steam from the high vessel therebelow through the cup to the sauna room.

In one embodiment the cup is ceramic. The cup may include a protuberance in the bottom with the channel set in the protuberance, whereby the cup has its own water space.

There may be at least one narrow radial groove provided in the protuberance in the cup, thereby to prevent the channel from being blocked, even if a stone is placed directly on top of the channel.

Preferably the diameter of the channel in the cup is in the range of 15–30% of the diameter of the high vessel.

With such a humidifier, the rapid vaporization of the water is still achieved in a manner characteristic of a humidifying vessel, but the vaporization is controlled by means of the cup set on top of the tall tubular vessel.

There may be one or more high, most advantageously, cylindrical vaporization vessels. The cup referred to is set on top of all of them and a duct runs from its base from the top of each vessel to the inside of the cup. During vaporization, there is still a characteristic noise, but the noise is lessened by the cup.

These and other features and advantages of the invention will be more fully understood from the following detailed description of one humidifier of the invention taken together with the accompanying drawings.

DETAILED DESCRIPTION OF THE INVENTION

Figure 1:
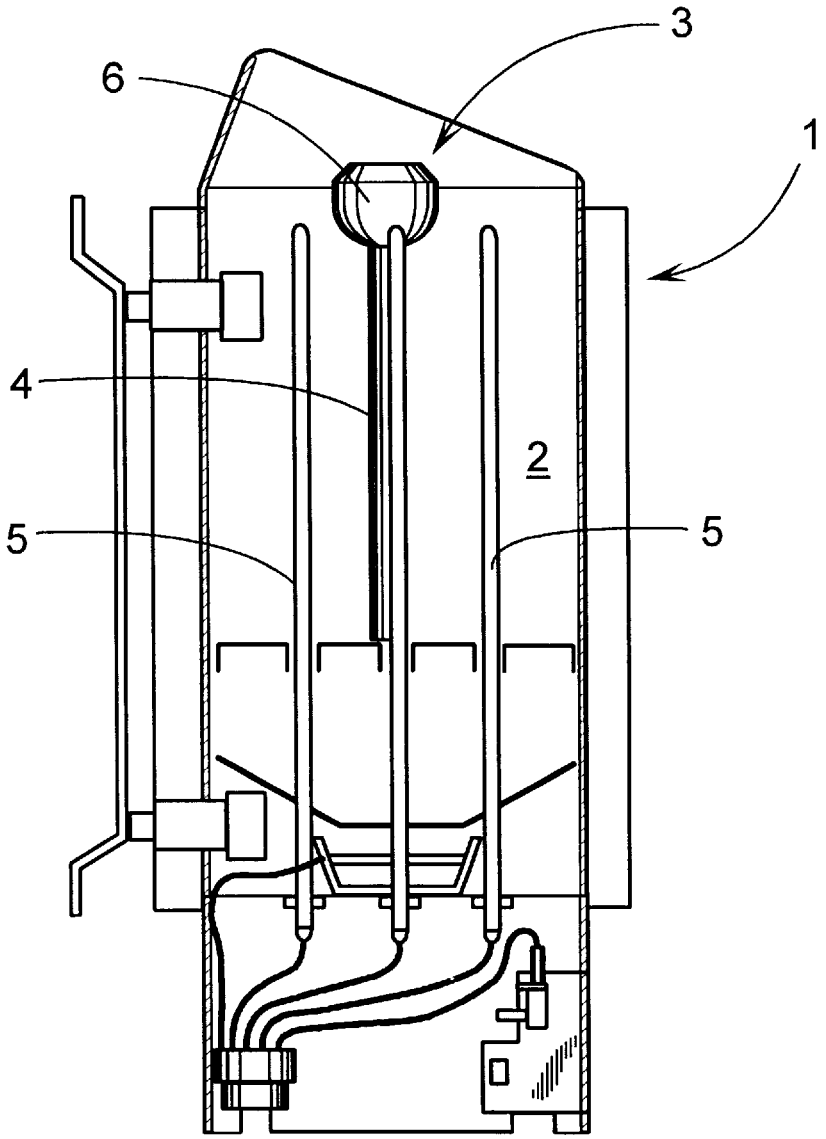
FIG. 1 is a schematic view of a humidifier for use in a sauna stove constructed in accordance with the present invention and settable in the stone space of an ordinary electric sauna stove.

Referring now to the drawings in detail, numeral 3 generally indicates a humidifier for use in a sauna stove. As is hereinafter more fully described, the humidifier 3 is quiet and safe.

In FIG. 1, the electric sauna stove is shown without stones, so that the location of the humidifier 3 between the resistances 5 in the stone space 2 of the stove 1 can be seen. In this case, the humidifier consists of a pipe closed at the base, i.e. of a cylindrical reservoir, which is marked with the reference number 4 in the illustration. Cup 6 is on top of the cylindrical reservoir 4. There can be several cylindrical reservoirs in the same manner as shown in utility model 1965. The cup would then extend from its base to the tops of all the reservoirs. The cylindrical reservoir 4 is set on the bottom of the stone space, into which the sauna stones are placed. In this way it remains surrounded by stones. The heat of the stone space vaporizes the water in the cylindrical reservoir 4 so that steam spreads into the sauna before and during bathing.

Cup 6 is placed on top of the cylindrical reservoir 4 according to FIG. 1. The cup is most advantageously ceramic, but it can also be made from stone. A ceramic cup is highly durable.

Figure 2:
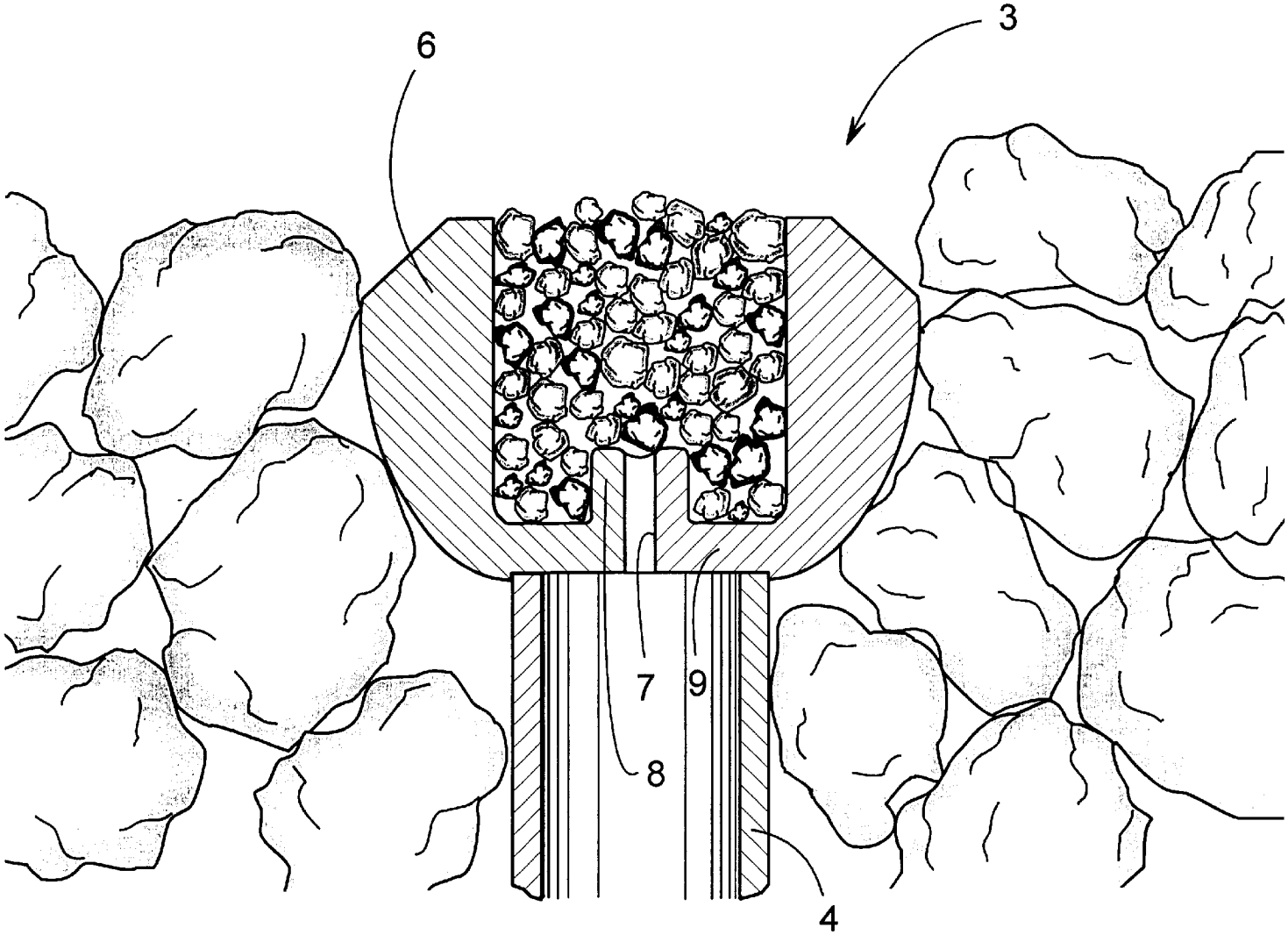
FIG. 2 is an environmental sectional view of the humidifier of FIG. 1 illustrating a cup component of the humidifier in cross-section.

FIG. 2 shows the construction of the cup of the humidifier in greater detail. The base of cup 6 has a depression 9 corresponding to the shape of the cylindrical reservoir 4, so that cup 6 sits firmly on top of the cylindrical reservoir 4. There are small stones in the cup 6, which, with duct 7, effectively dampen discharges of steam. In place of the stones, there could be, for example, a ceramic component, which forms, with the inner surface of the cup, a suitable outlet channel. The diameter of the channel 7 of cup 6 is 15–30% of the diameter of vessel 4.

Channel 7 forms a path for steam from the cylindrical reservoir beneath into cup 6. Channel 7 ends in a protuberance 8 inside the cup, so that there is a small water space within the cup itself. There are grooves radial to channel 7 on top of protuberance 8, which prevent the channel becoming totally blocked, even though a stone is placed on top of it.

Here, cup 6 is a separate component, so that parts can be easily serviced. It can also be permanently attached to the cylindrical reservoir, if this is wished.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A humidifier for use in a sauna stove, comprising an elongated vessel open at the top, forming a store for the water to be vaporized, and adapted to be placed in the stone space of the sauna stove, proximate the source of heat, for the stove, such that when in use, the heat from the heat source vaporizes the water in the vessel, to spread steam to the sauna room, the humidifier further comprising at least one cup placed on top of the elongated vessel, said cup being filled with stones, and said cup including a channel to lead steam from the elongated vessel therebelow through the cup to the sauna room.

2. A humidifier according to claim 1, characterized in that the cup is ceramic.

3. A humidifier according to claim 1, characterized in that said cup includes a protuberance in the bottom of the cup and said channel is set in said protuberance, whereby said cup defines a water space.

4. A humidifier according to claim 1, characterized in that the diameter of said channel of said cup is in the range of 15–30% of the diameter of the elongated vessel.

* * * * *